US006098577A

United States Patent [19]

Wu

[11] Patent Number: 6,098,577

[45] Date of Patent: Aug. 8, 2000

[54] INTERNAL COMBUSTION ENGINE COOLING DEVICE

[75] Inventor: Yuh-Yih Wu, Taipei, Taiwan

[73] Assignee: Industrial Technology Research Institute, Hsinchu, Taiwan

[21] Appl. No.: 09/181,056

[22] Filed: Oct. 27, 1998

[51] Int. Cl.[7] ..... F01P 1/04

[52] U.S. Cl. ..... 123/41.35; 123/196 R

[58] Field of Search ..... 123/41.35, 41.38, 123/196 R; 184/11.1, 13.1

[56] References Cited

U.S. PATENT DOCUMENTS 2,410,929 11/1946 Crause ..... 184/11.1
3,307,655 3/1967 Hatz ..... 184/11.1

*Primary Examiner*—Marguerite McMahon
*Assistant Examiner*—Jason Benton
*Attorney, Agent, or Firm*—Pro-Techtor International Services

[57] ABSTRACT

An internal combustion engine cooling device, comprising: a cylinder, having a lower end with an oil reservoir containing oil; a piston, moving inside the cylinder; and a crankshaft, mounted on the lower end of the cylinder. The crankshaft is connected to the piston, performing a rotating movement, further having several counterweights which take part in the rotating movement and partly dip into the oil during the rotating movement. Each of the counterweights has an oil reserve duct, which ends in an oil duct inlet and an oil exit and dips into the oil during the rotating movement. Thus oil is allowed to enter the oil reserve duct through the oil duct inlet, undergoing a centrifugal force and being splashed out through the oil exit, such that the cylinder and the piston are cooled and lubricated.

2 Claims, 4 Drawing Sheets

INTERNAL COMBUSTION ENGINE COOLING DEVICE

BACKGROUND OF THE INVENTION

1. Field of the Invention

The present invention relates to an internal combustion engine cooling device, particularly to a lubricating system for cylinder and piston of an internal combustion engine with effective cooling.

2. Description of Related Art

An internal combustion engine requires, especially when running at a high speed and high load, uninterrupted lubricating and cooling of cylinder and piston, so as to work properly.

An internal combustion engine is generally cooled by water in the water jackets that surround the cylinder or by air passing along external cooling-fins. This cools effectively the cylinder from outside. However the cooling water increases the engine weight and air-cooled is not so effective. Therefore an additional method is used to cool engines from within.

Internal cooling of an internal combustion engine is achieved in two ways. In the first method, a dipper is attached to the connecting-rod. There is an oil reservoir in the crankcase. On the downstroke of the piston the dipper reaches into the oil in the crankcase, splashing it while the piston moves on. However, since the splashed oil is diffused into small droplets, no effective heat dissipation results. So while there is a good lubricating effect, cooling remains insufficient.

The second method for internal cooling relies on unburned fuel taking away heat from the combustion of a rich fuel-air mixture. This method, however, results in higher fuel consumption and increased pollution by exhaust gases that still contain unburned fuel, running counter to efforts or regulations in an increasing number of countries to reduce fuel consumption and air pollution.

SUMMARY OF THE INVENTION

The main object of the present invention is to provide an internal combustion engine cooling device with effective lubrication and cooling for reduced engine wear and increased lifetime.

Another object of the present invention is to provide an internal combustion engine cooling device allowing for a lean fuel-air mixture for reduced fuel consumption and pollution.

The present invention can be more fully understood by reference to the following description and accompanying drawings.

DETAILED DESCRIPTION OF THE PREFERRED EMBODIMENTS

Figure 1:
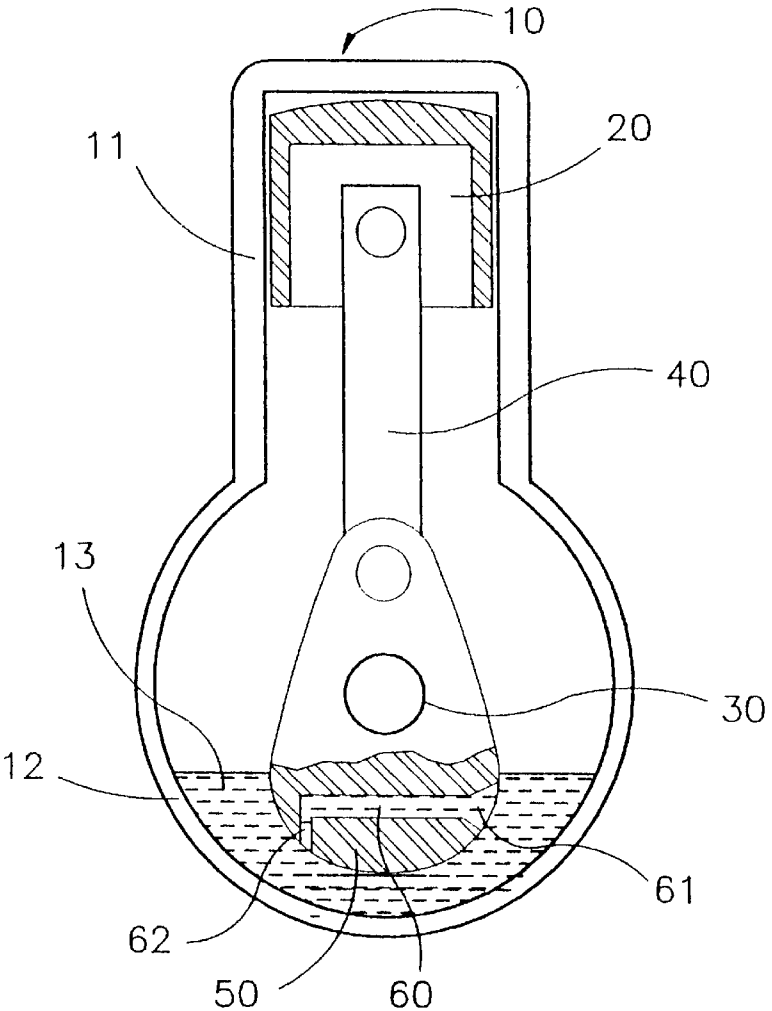
FIG. 1 is a cross section of the internal combustion engine cooling device of the present invention in the first embodiment.

As shown in FIG. 1, the internal combustion engine cooling device of the present invention is used in an internal combustion engine l0, comprising: a cylinder 11; a piston 20, moving inside the cylinder 11 in a reciprocating movement; a crankshaft 30; a connecting rod 40, connecting the piston 20 and the crankshaft 30; and a crankcase 12, filled with oil 13, thus forming an oil reservoir for lubricating and cooling the internal combustion engine 10.

When fuel inside the cylinder 11 is ignited and burnt, the piston 20 is pushed downwards. The connecting rod 40 transmits the linear movement to the crankshaft 30, causing a rotating movement thereof. The counterweight 50 on the crankshaft 30 ensure that the rotating movement goes smoothly. During the rotating movement of the crankshaft 30, when reaching a lowermost position, the counterweight 50 dip into the oil 13.

Figure 2:
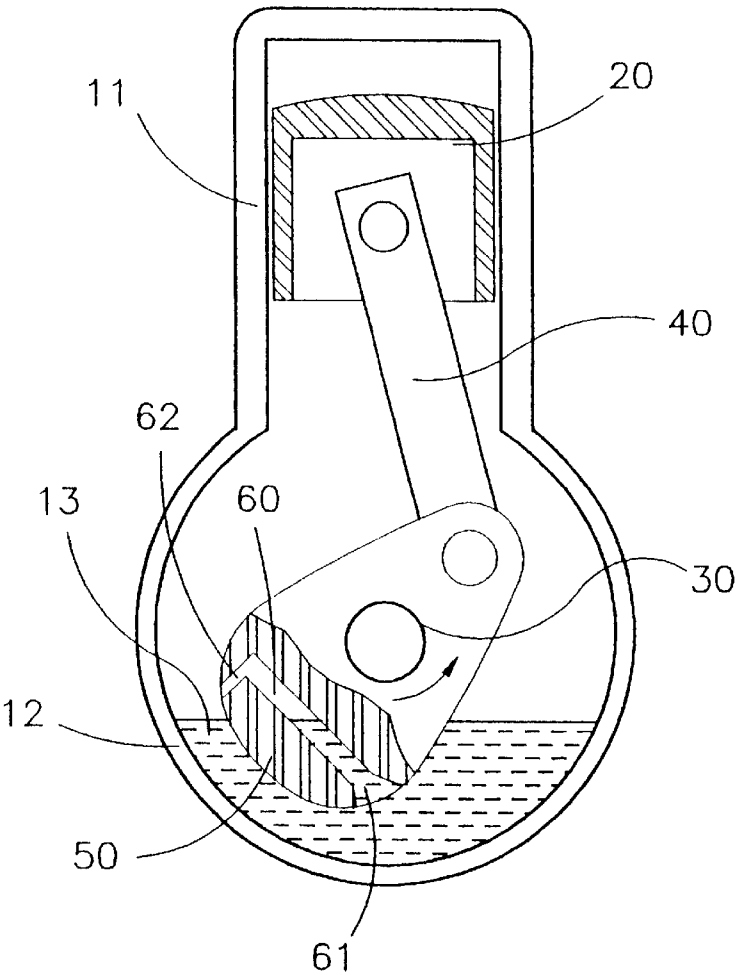
FIG. 2 is a schematic illustration of the present invention in the first embodiment at the time oil enters the oil reserve duct in the crankshaft counterweight.
Figure 3:
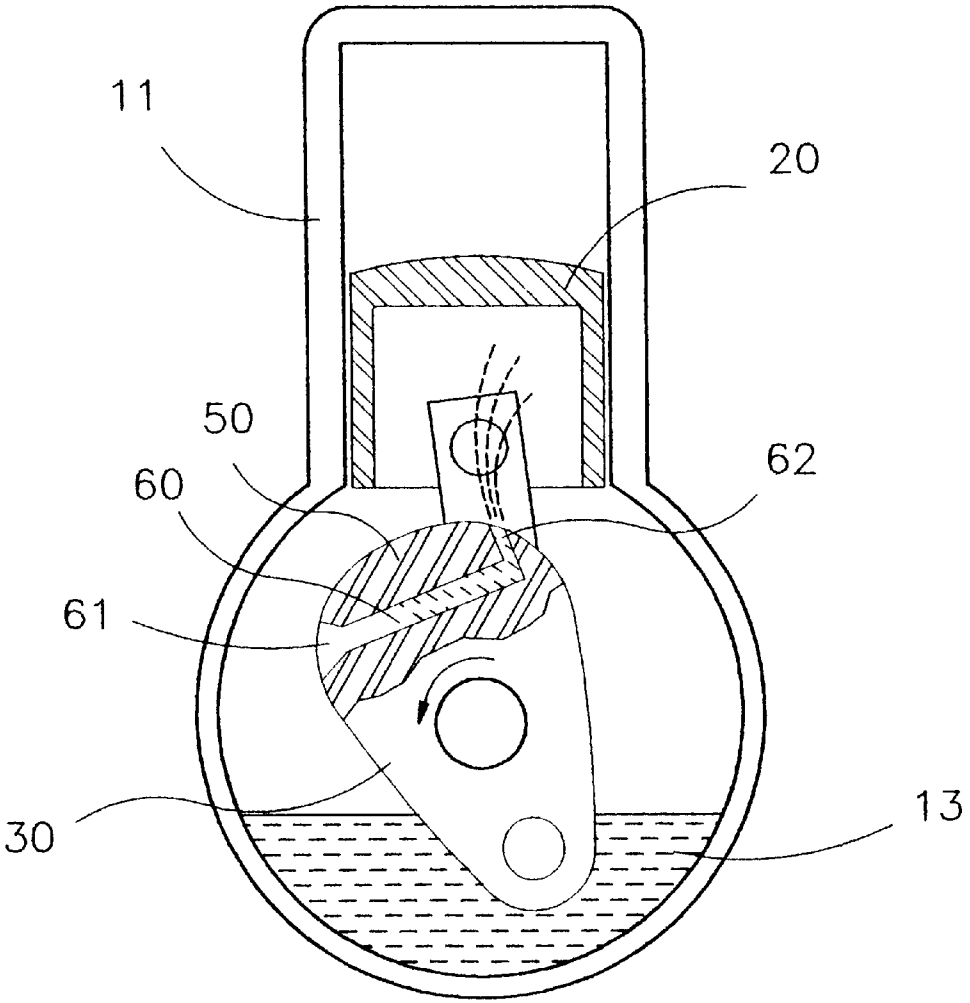
FIG. 3 is a schematic illustration of the present invention in the first embodiment at the time oil leaves the oil reserve duct through the oil exit, splashing against the piston.

The main characteristic of the present invention is an oil reserve duct 60, passing through the counterweight 50 in a tangential direction with respect to the rotating movement of the crankshaft 30. The oil reserve duct 60, though straight in the FIG. , may be shaped like an arc, as well. The oil reserve duct 60 has an oil duct inlet 61 on the side of the counterweight 50 that touch the oil 13 first during the rotating movement for oil entering, and an oil exit 62 opposite thereto. The oil inlet 61 has bell shaped mouth for oil entering easily. The oil exit 62 is oriented in the direction of the centrifugal force generated during the rotating movement and has a cross-section that is smaller than the cross-section of the oil duct inlet 61 for storing oil. As shown in FIGS. 2 and 3, once the oil duct inlet 61 is submerged in the oil 13, oil enters the oil reserve duct 60 in the course of the rotating movement. Inertia causes the oil in the oil reserve duct 60 to proceed towards the oil exit 62 and then, because of the centrifugal force generated during the rotating movement, to sprinkle out of the oil exit 62.

The oil exit 62 is located at the end of the oil reserve duct 60 on the one end of the counterweight 50. As shown in FIG. 3, when the counterweight 50 reach an uppermost position within the crankcase 12 during the rotating movement, the oil exit 62 points towards the piston 20 in the cylinder 11. Oil leaving the oil exit 62 because of the centrifugal force generated during the rotating movement is drawn directly into the cylinder 11, against the piston 20. The cross-section area of the oil exit 62 can be determined by the flow rate through the oil exit 62. With a faster rotating movement, the centrifugal force is increased, and oil is splashed undispersed and with a large force against the piston 20 and the cylinder 11, ensuring a good cooling effect.

Since oil is directly splashed on the cylinder 11 and the piston 20, not only a good lubricating effect is achieved, but also by immediately dissipating heat from the cylinder 11 and the piston 20, the operating temperature of the engine is reduced. No additional internal cooling by a rich fuel-air mixture is required. Thus fuel consumption and exhaust emissions are improved.

Figure 4:
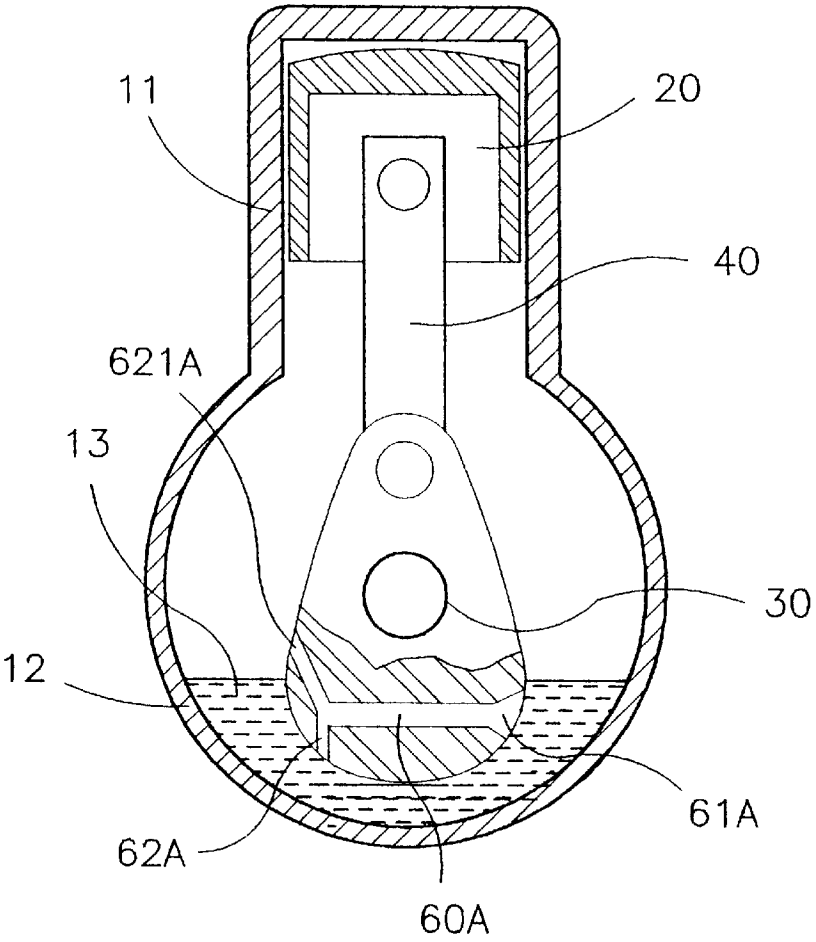
FIG. 4 is a cross section of the internal combustion engine cooling device of the present invention in the second embodiment.

For the arrangement of the oil reserve duct 60 and the oil exit 62, several modifications are possible. As shown in FIG. 4, in a second embodiment of the present invention, an oil reserve duct 60A like the oil reserve duct 60 of the first embodiment is employed. The oil reserve duct 60A has an oil exit 62A, with a connecting duct 621A branching off from the oil exit 62A in the opposite direction thereof. When the counterweight 50 is submerged in the oil 13, the connecting duct 621A points upwards, providing an exit path for air displaced by oil entering the oil reserve duct 60A. Thus oil enters the oil reserve duct 60A smoothly.

Figure 5:
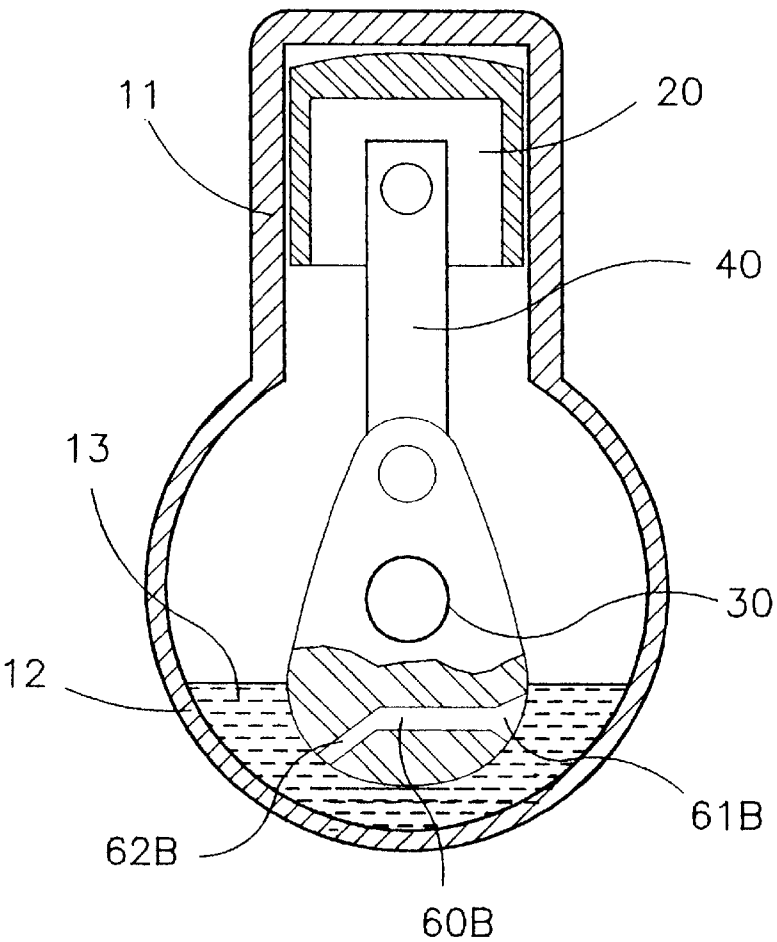
FIG. 5 is a cross section of the internal combustion engine cooling devic of the present invention in the third embodiment.

Referring to FIG. 5, in a third embodiment of the present invention, an oil reserve duct 60B is used, ending in an oil exit 62B that is oriented at an oblique angle thereto. The oblique angle may take any suitable value for adjusting to a desired friction of the flow of oil and a desired flow rate thereof.

Figure 6A:
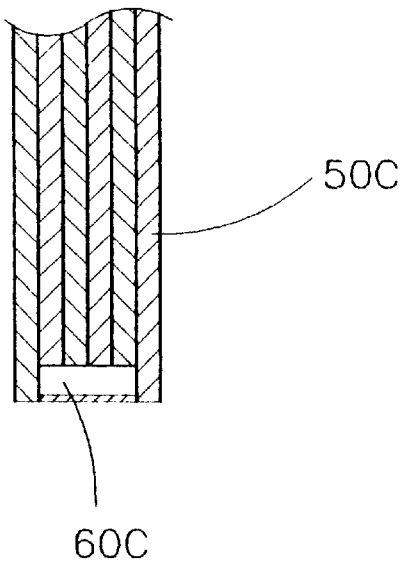
FIG. 6A is a sectional view, taken along line 6A - 6A in FIG. 6.
Figure 6:
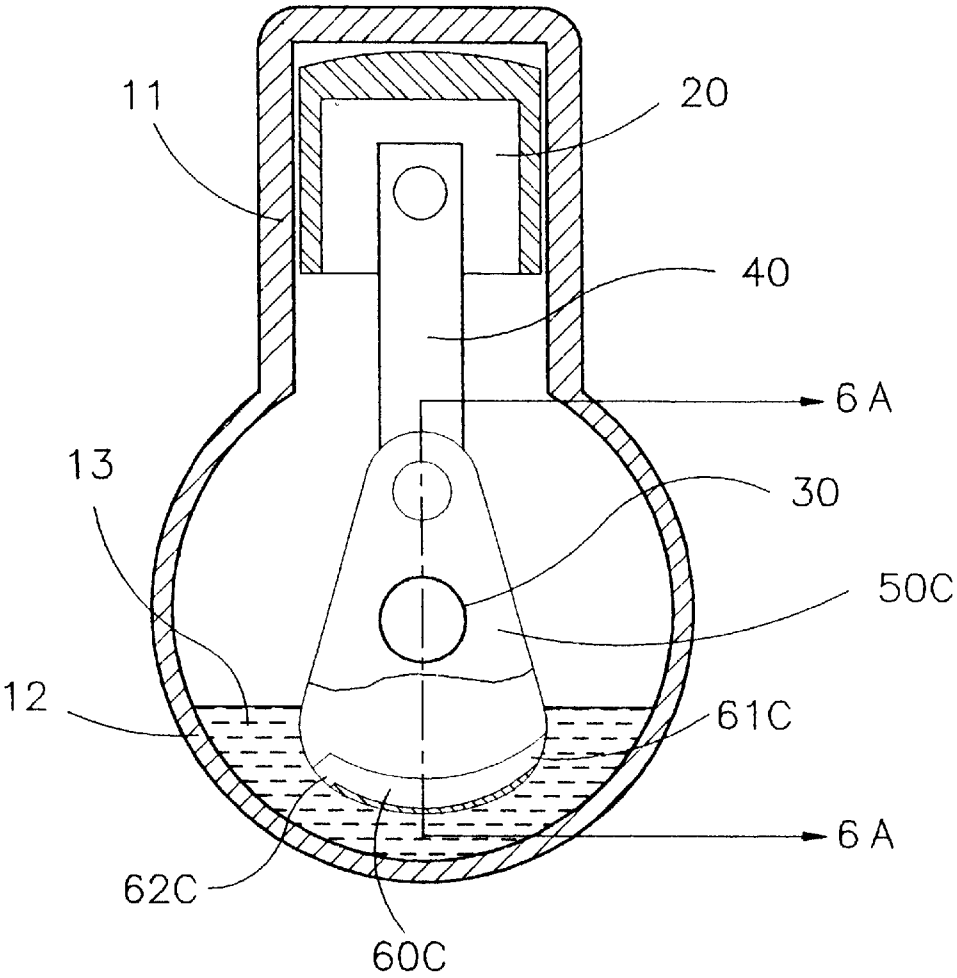
FIG. 6 is a cross section of the internal combustion engine cooling devic of the present invention in the fourth embodiment.

The oil reserve duct and the oil exit, as described in the above embodiments of the present invention are integrated into the counterweight 50. However, another way of implementing the oil reserve duct and the oil exit is possible, as well. As shown in FIG. 6, the present invention in a fourth embodiment has a counterweight 50C, made of several layers of metal sheet, and an oil reserve duct 60C and an oil exit 62C with metal sheet walls welded thereto.

The internal combustion engine cooling device of the present invention provides for improved engine cooling, increasing the lifetime of the engine. At the same time, direct internal cooling of the engine is achieved without resorting to a rich fuel-air mixture, such that both fuel consumption and pollution are reduced, in accordance with increasingly strict regulations in world wide.

While the invention has been described with reference to a preferred embodiment thereof, it is to be understood that modifications or variations may be easily made without departing from the spirit of this invention which is defined by the appended claims.

What is claimed is:

1. An internal combustion engine cooling device, comprising:

a cylinder having a lower end with an oil reservoir;

a piston that moves inside said cylinder; and a crankshaft mounted on a bottom end of said cylinder, said crankshaft is connected to said piston, said crankshaft has a counterweight that aids a rotating movement of said crankshaft, said counterweight has a oil reserve duct with an oil duct inlet and an oil exit machined into said counterweight such that said oil reserve duct is an integral element of said counterweight, said counterweight dips into oil in said oil reservoir during said rotating movement so that said oil reserve duct receives oil through said oil duct inlet during said rotating movement, a centrifugal force then causing said oil to exit said oil reserve duct through said oil exit when said counterweight is at an uppermost position in said cylinder during said rotating movement, such that said cylinder and said piston are cooled and lubricated by said oil.

2. The internal combustion engine cooling device according to claim 1, wherein:

a connecting duct branches off said oil exit, said connecting duct providing an escape path for air in said oil reserve duct when oil enters said oil reserve duct.

* * * * *